US005105883A

United States Patent [19]

Bode

[11] Patent Number: 5,105,883

[45] Date of Patent: Apr. 21, 1992

[54] CASING RESTRICTION SUB

[76] Inventor: Robert E. Bode, 12500 Melville, No. 109A, Montgomery, Tex. 77356

[21] Appl. No.: 678,007

[22] Filed: Apr. 1, 1991

[51] Int. Cl.[5] ..... E21B 47/09; E21B 47/04

[52] U.S. Cl. ..... 166/255; 166/154; 166/242; 166/318; 166/281; 166/285; 137/553; 137/557

[58] Field of Search ..... 166/70, 153, 290, 291, 166/310, 382

[56] References Cited

U.S. PATENT DOCUMENTS

| | | | |
|---|---|---|---|
| 3,638,730 | 2/1972 | Smith | 166/153 |
| 4,190,111 | 2/1980 | Davis | 166/291 |
| 4,674,573 | 6/1987 | Bode | 166/291 |
| 4,907,649 | 3/1990 | Bode | 166/70 |

*Primary Examiner*—Ramon S. Britts
*Assistant Examiner*—Frank N. Tsay
*Attorney, Agent, or Firm*—Dodge, Bush, Moseley & Riddle

[57] ABSTRACT

In accordance with an illustrative embodiment of the present invention, a restriction sub apparatus for use during well cementing operations includes a tubular body having upper and lower internal recesses, a restriction ring having a shoulder engaged with the upper recess, and depending, inwardly inclined fingers at its lower end, and a back-up rubber ring mounted in the lower recess that yieldably resists expansion of the fingers as the drive plate of a displacement plug passes downward therethrough to provide a positive surface indication in the form of a pressure change that the plug is located at a particular depth.

19 Claims, 1 Drawing Sheet

FIG.1
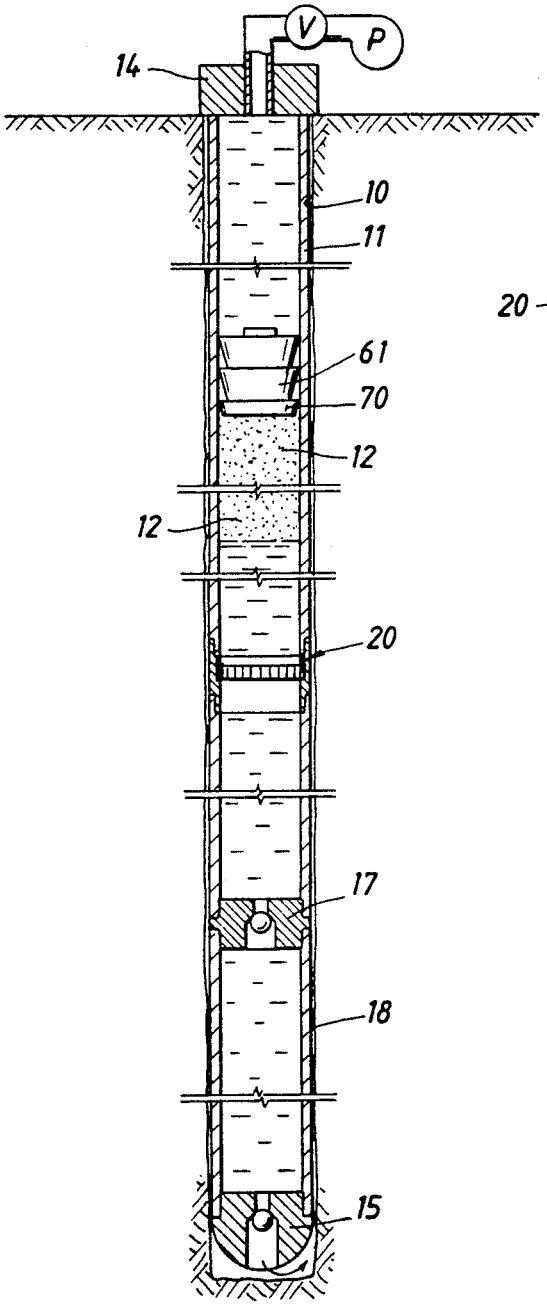
FIG.2
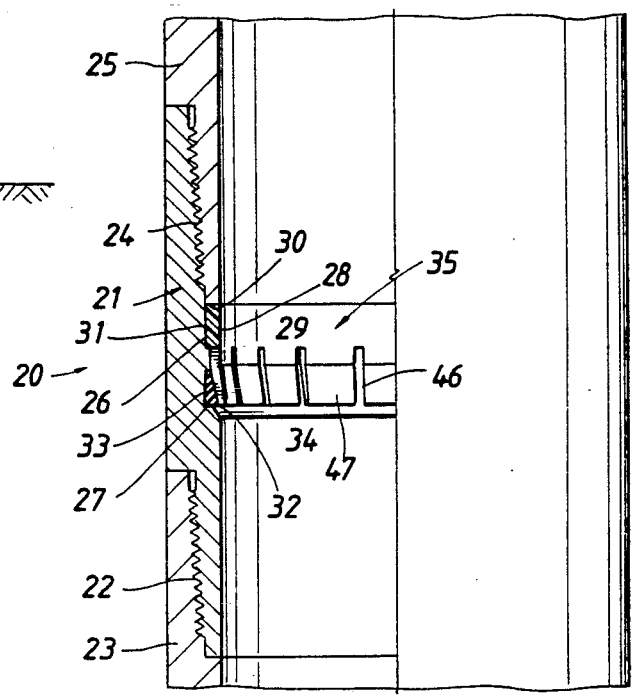
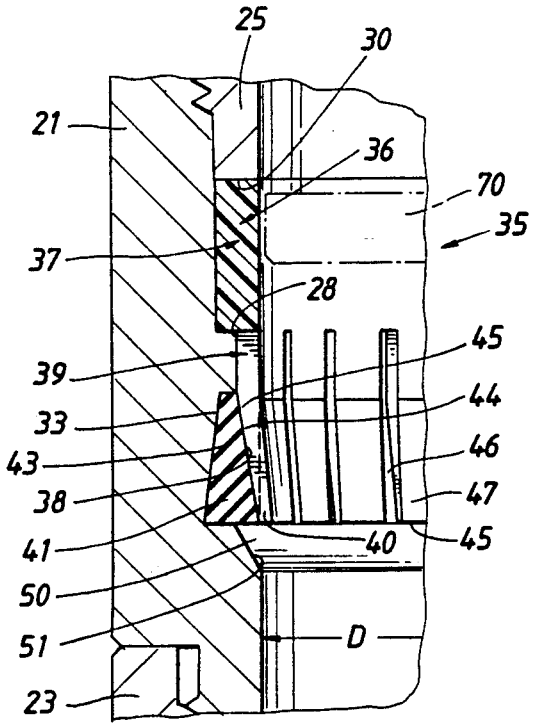
FIG.3

CASING RESTRICTION SUB

FIELD OF THE INVENTION

This invention relates generally to cement plug monitoring systems, and particularly to a new and improved restriction means that co-acts with a cement displacement plug to provide a positive surface indication of when the top of a cement column that is being displaced into a casing reaches a predetermined distance from the bottom of the casing.

BACKGROUND OF THE INVENTION

Plugs are used in the cementing of wells for a variety of purposes, for example to provide an interface between the upper and/or lower ends of a cement slurry column and the mud or displacement fluids in the casing. When a calculated volume of cement slurry is displaced down the casing ahead of a displacement fluid, a displacement plug can be used to separate the top of the column from the displacement fluid. After substantially all of the slurry has been pumped into the annulus between the casing and the well bore wall a surface indication is needed. When a cement displacement plug bumps a float collar near the lower end of the casing, most all of the slurry will have been displaced into the annulus outside the casing.

As noted above, a typical procedure is to position the displacement plug at the top of the slurry column and then pump the plug downward with the column ahead of it. On occasion, a plug also can be run ahead of the column. When a top displacement plug is stopped by the float collar, it will have wiped the interior of the casing clean as it passed downward.

A high degree of skill and occasional guesswork is required during a well cementing operation to determine when a displacement plug has reached a certain downhole location in the casing. Various devices have been used, such as a simple pipe nipple with an internal rubber sleeve that provides a reduced diameter in the bore, in an effort to cause an observable pump pressure surge to occur at the surface when the plug passes through this bore. One or more improvements over such devices are disclosed and claimed in my U.S. Pat. No. 4,907,649 issued Mar. 13, 1990 where corrugated and fingered sleeves are used to momentarily restrict downward movement of a plug. Although this approach represents a distinct advance in the art, there remains a continuing need for a simple and reliable restriction sub that provides a distinct and positive surface indication of the point in time when a displacement plug reaches a certain point in casing. Such an indication would prevent overdisplacement of the cement, and attendant difficulties.

The general object of the present invention is to provide a new and improved restriction sub apparatus which impedes the passage of a cement displacement plug therethrough in a manner such that a positive surface indication is given.

SUMMARY OF THE INVENTION

This and other objects are attained in accordance with the concepts of the present invention through the provision of a restriction sub apparatus comprising a tubular body having internal annular recess means therein, a restriction means including a plastic ring having a flexible lower portion, and a elastomer ring that backs up the plastic ring and is fixed in the recess in the body in a manner such that as a displacement plug fitted with a drive plate passes downward through the lower portion of the plastic ring, it and the elastomer ring are expanded to provide a temporarily increase in the inner diameter of the assembly sufficient to enable its passage. The resistance afforded by the restriction assembly to such diameter increase produces a temporary and distinct pump pressure increase at the surface which signals that the plug, and thus the top of the cement column, is located at that particular depth or location in the casing, or at a particular distance above the bottom of the casing string. The pumping procedures then can be altered as necessary. The present invention is quite simplified in construction, and is highly reliable, and allows a determination of pumping efficiency.

BRIEF DESCRIPTION OF THE DRAWINGS

The present invention has other objects, features and advantages that will become more clearly apparent in connection with the following detailed description of a preferred embodiment, taken in conjunction with the appended drawings in which:

FIG. 1 is a schematic view of a well where one or more cement plugs and a restriction sub are being used in a casing string that lines, the well bore;

FIG. 2 is a side view, partly in elevation and partly in section, of a restriction assembly in accordance with the present invention; and FIG. 3 is a fragmentary view showing the restriction assembly as well as the drive plate of a displacement plug that is about to pass downward through the restriction assembly of FIG. 2.

DETAILED DESCRIPTION OF A PREFERRED EMBODIMENT

Referring initially to FIG. 1, a well bore 10 having a casing 11 is shown with a column of cement slurry 12 being pumped downward therein. When the bottom of the column 12 reaches a float shoe 15, further pumping causes the cement to be displaced into the annulus 18 between the casing 11 and the wall of the well bore 10. The casing 11 is suspended at the top of the well at a well head 14. The float shoe 15 having a rounded nose is attached to the bottom of the casing 11, and a float collar 17 can be located a suitable distance, for example about 80 feet above the float shoe 15. A restriction assembly 20 that is constructed in accordance with the present invention is connected in the casing string 11 a selected distance, for example 150–200 feet, above the float collar 17.

As shown in FIG. 2, the assembly 20 includes a tubular monitor sub 21 having external threads 22 that connect to the casing end portion 23, and internal threads 24 that connect to the casing end portion 25. The sub 21 has upper and lower internal annular recesses 26 and 27 formed therein. The upper recess 26 provides an upwardly facing shoulder 28 which opposes the lower end face 30 of the end portion 25 of the casing, and the outer wall 31 thereof preferably in cylindrical. The lower recess 27 is outlined by an upward facing shoulder 32, an upwardly and inwardly inclined wall 33, and a downwardly facing shoulder 34. An inwardly extending shoulder 29 is formed between the recesses 26,27. Fitted within the recesses 26,27 is a restriction ring assembly indicated generally at 35.

As shown in more detail in FIG. 3, the assembly 35 includes a ring member 36 having an upper portion 37 and a lower portion 38 that are joined together by a center section 39. The portions 37 and 39 generally are tubular, however the lower portion 38 inclines downward and inward as shown. The triangular region 40 inside the dotted line 41 past into the inner diameter D of the monitor sub 21 to provide a restricted area in the casing 11 which is located a predetermined distance above its bottom end. An elastomer ring member 43 is fitted into the lower recess 27 and has an inclined outer wall that fits against the recess wall 33, and an inner wall 44 that is inclined to match the inclination of the outer wall 45 of the lower portion 38 of the ring member 36. The ring member 36 preferably is made of a plastic material such as nylon, and the elastomer ring 43 preferably is made from a material such as rubber having a Durometer value of about 80. The drive plate 70 that is fixed to the lower end of the upper plug 61 is shown in phantom lines in FIG. 3. The plate also preferably is made of a plastic such as nylon.

The ring member 36 has a plurality of circumferentially spaced radially extending slots 46 cut from its lower end surface 45 upward to approximately the top of the center section 39. The slots 46 form a plurality of depending fingers 47 that are somewhat flexible. The lower ends of the fingers 47 can be expanded outward against the resistance afforded by the rubber ring 43, and by their own resilience, to provide a temporary increase in the inner diameter of the restriction assembly 20 to the diameter D of the inside wall of the casing 11, which enables the displacement plug with its drive plate 70 to pass downward therethrough.

OPERATION

In operation, the casing 11 is run into the well with the float shoe 15 attached to the lower end thereof, and the float collar 17 located a known distance above the float shoe. As mentioned above, the restriction assembly 20 is typically connected in the casing string 11 about 150–200 ft. above the float collar 17. As a generalization, the restriction assembly 20 is located one or two joints of casing above the expected final depth of the top end of the cement column in the casing 11.

A conditioning fluid can be pumped into the casing 11 first to clean up and condition the well before the cementing process is begun. If desired, a bottom cement plug 60 can be run first to provide an interface that substantially prevents mixing of mud and/or the conditioning fluid with the cement slurry at the lower end of the column. After a selected volume of slurry has been displaced into the casing 11, the top displacement plug 61 is placed in the casing at the top of the column 12. The top plug also prevents mixing of the displacement fluid and/or mud and the slurry at the top end of the column. As the displacement plug or plugs and the cement column travel downward in the casing 11, the top plug 61 tends to wipe the interior of the casing 11 clean, leaving substantially no cement on the inner walls thereof.

The lower plug, in the event one is used, will pass through the restriction assembly 20 first and then be pumped on down to the top of the float collar 17. At this location it will rupture to allow slurry to pass through its center. When the top plug 61 having the drive plate 70 with a diameter that is only slightly smaller than D reaches the restriction assembly 20, the plate enters the central passage through the element 36. When the plate encounters the fingers 47, they are forced laterally outward due to increased axial pressure forces on the plug body. The rubber ring member 43, being substantially incompressible, extrudes somewhat into the region 50 above the chamfer 57 as well as into the areas between the fingers 47. The overall resistance afforded by the restriction assembly 20 to downward passage of the top displacement plug causes a positive pressure surge indication to be given at the surface gauges. The top of the cement column will be just below, or at, the restriction assembly 20, and at a known distance from the float shoe 15.

Such positive surface indication gives the precise downhole position of the plug, and enables the overall efficiency of the pumping system can be evaluated. Since each pump stroke represents a certain volume, and since the total volume inside the casing 11 from the restriction assembly 20 to the surface is known, there is a theoretical number of pump strokes that should be adequate to position the top of the column at the level of the restriction assembly 20. This number can be compared to the actual number of pump strokes required for a determination of the efficiency of the pumping system. A highly accurate efficiency calculation is made possible by the present invention, due to the positive surface indication given at the surface of exactly when the top of the cement column is at the depth thereof.

The bottom displacement plug 60 can be fitted with a rupture disk so that when it reaches the float collar 17 and stops, the disk ruptures to allow fluids to pass through the center of the plug. Its principle purpose is to mechanically separate, and to provide an interface between, the mud and the cement slurry. However, the upper plug 61 is fitted with the drive plate 70. Thus when the upper plug 61 reaches the monitor assembly 20, a higher pump pressure is required to drive it through the assembly. This provides a noticeable and positive pressure increase at the surface. The timing of the pressure increase or surge indicates the exact location of the plug, and a calculation can be swiftly made to determine the pumping efficiency. Of course more than one monitor assembly 20 can be used in the casing string 11 to continually monitor the location of the upper displacement plug 61.

It now will be recognized that a new and improved restriction assembly has been disclosed that is useful in cementing operations. Since certain changes or modifications may be made in the disclosed embodiment without departing from the inventive concepts involved, it is the aim of the following claims to cover all such changes and modifications that fall within the true spirit and scope of the present invention.

What is claimed is:

1. A restriction apparatus for use in providing a surface indication of the downhole position of a displacement plug in a well casing, comprising; a tubular body having means at its ends for connecting said body in the casing, said body having an internal bore and internal annular recess means; and a ring assembly mounted in said recess means, said ring assembly including a first member having a first portion thereof extending into said bore to restrict the passage of a displacement plug downwardly therethrough, said first portion being adapted to be expanded outward during such passage; and a resilient second member surrounding said first portion and arranged to yieldably resist expansive movement thereof.

2. The apparatus of claim 1 wherein said recess means includes an upper recess and a lower recess, said lower recess receiving said resilient second member and said upper recess receiving a second portion of said first member.

3. The apparatus of claim 2 wherein said upper recess is generally cylindrical, and said lower recess has an outer wall that inclines downward and outward with respect to said internal bore.

4. The apparatus of claim 3 wherein said first portion of said first member has means dividing it into a plurality of fingers that incline downward and inward with respect to said bore.

5. The apparatus of claim 4 wherein said resilient second member has an inner wall surface that is inclined to match the inclination of said fingers and which engages outer wall surfaces of said fingers.

6. The apparatus of claim 5 further including means forming an annular space adjacent said lower recess into which said resilient second member can extrude during expansions of said fingers.

7. The apparatus of claim 1 wherein said first member is made of a plastic material.

8. The apparatus of claim 1 wherein said resilient second member is made of a rubber.

9. A restriction apparatus for use in causing a momentary increase in pump pressure at the surface that is indicative of the downhole location of a displacement plug, comprising; a tubular body having a bore and means at its opposite ends for coupling said body in a pipe string; cylindrical recess means in said body providing an upwardly facing shoulder; conical recess means below said cylindrical recess means and providing opposed shoulder surfaces and a downwardly and outwardly inclined wall surface between said shoulder surfaces; a first ring member having an outwardly directed shoulder received in said cylindrical recess means, said first ring member having an expansible lower portion overlaying said conical recess means, said lower portion inclining downward and inward with respect to said bore and providing a restriction therein; and a resilient elastomer ring member mounted at least partially in said conical recess means and positioned externally of said expansible lower portion for yieldably resisting expansion of said lower portion as a displacement plug having a drive plate passes downward therethrough.

10. The apparatus of claim 9 wherein said lower portion has a plurality of radially arranged, downwardly opening slots at circumferentially spaced points around its periphery that divide said lower portion into a plurality of depending fingers that each incline downward and inward with respect to, and into, said bore.

11. The apparatus of claim 10 wherein said first ring member has a cylindrical mid-portion of a lesser outer diameter than said outwardly directed shoulder, said tubular body having an inwardly directed shoulder between said recess means that engages said mid-portion to prevent downward movement of said first ring member relative to said body.

12. The apparatus of claim 11 wherein said elastomer ring member has conical inner and outer walls, said outer conical wall engaging the conical inner wall of said conical recess means and said conical outer wall engaging said fingers.

13. The apparatus of claim 12 wherein said conical walls of said elastomer ring member incline in opposite directions.

14. The apparatus of claim 13 further including means providing space for extrusion of said elastomer ring member during expansion of said lower portion of said first ring member by a plug member.

15. The apparatus of claim 10 wherein said slots provide room for extrusion of said elastomer ring member during expansion of said fingers by a plug member.

16. The apparatus of claim 9 where said first member is made of a plastic material such as nylon.

17. The apparatus of claim 16 wherein said elastomer ring member is made of rubber having a Durometer value of about 80.

18. A method of determining the efficiency of a pumping system during a well cementing operation where a column of cement slurry is displaced down a well casing in response to strokes of a pump, comprising the steps of: placing a displacement plug at the top of said column and pumping said column down a well casing ahead of said plug; providing a positive surface indication when said plug reaches a predetermined distance from the bottom of the casing; determining the theoretical number of pump strokes required to position said plug at said distance based upon the volume of the bore of the well casing thereabove, and the displacement volume of each pump stroke; determining the actual number of pump strokes required to position said plug at said distance; and determining the pumping efficiency from the relationship between said actual number and said theoretical number.

19. The method of claim 18 including the additional steps of: placing a restriction sub in the casing at said predetermined distance from its bottom; said restriction sub restricting the bore of the casing to a diameter that is less than the nominal inside diameter thereof; and causing the lower portion of said displacement plug to enlarge said restriction and create an increase in pumping pressure at the surface as it enlarges said restriction.

* * * * *